US009063510B2

(12) United States Patent
Furukawa

(10) Patent No.: US 9,063,510 B2
(45) Date of Patent: Jun. 23, 2015

(54) IMAGE FORMING APPARATUS

(71) Applicant: Brother Kogyo Kabushiki Kaisha, Nagoya-shi, Aichi-ken (JP)

(72) Inventor: Toshio Furukawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/290,290

(22) Filed: May 29, 2014

(65) Prior Publication Data

US 2014/0356010 A1 Dec. 4, 2014

(30) Foreign Application Priority Data

May 31, 2013 (JP) ..... 2013-115777

(51) Int. Cl.
*G03G 15/00* (2006.01)
*G03G 21/10* (2006.01)
*G03G 21/00* (2006.01)

(52) U.S. Cl.
CPC ..... *G03G 21/10* (2013.01); *G03G 21/0064* (2013.01)

(58) Field of Classification Search
CPC G03G 21/10; G03G 21/0058; G03G 21/0064
USPC ..... 399/71
See application file for complete search history.

(56) References Cited

U.S. PATENT DOCUMENTS

| | | | | |
|---|---|---|---|---|
| 8,711,380 | B2 * | 4/2014 | Burry et al. | 358/1.14 |
| 2008/0031649 | A1 * | 2/2008 | Dan | 399/71 |
| 2014/0119764 | A1 * | 5/2014 | Mizukoshi et al. | 399/71 |

FOREIGN PATENT DOCUMENTS

| | | | |
|---|---|---|---|
| JP | H07-160150 | A | 6/1995 |
| JP | H09-185208 | A | 7/1997 |
| JP | 2007-121657 | A | 5/2007 |

* cited by examiner

*Primary Examiner* — G. M. Hyder
*Assistant Examiner* — Michael Harrison
(74) *Attorney, Agent, or Firm* — Banner & Witcoff, Ltd.

(57) ABSTRACT

An image forming apparatus includes an image carrier, a cartridge, a collection member for collecting remaining toner which is attached to the image carrier after the toner image has been transferred from the image carrier to a recording medium; and a control device configured to selectively execute a first mode and a second mode. In a case of executing the first mode, the control device controls the collection member to return the remaining toner collected by the collection member to the image carrier with a first frequency. In a case of executing the second mode, the control device controls the collection member to return the remaining toner collected by the collection member to the image carrier with a second frequency that is smaller than the first frequency or to continuously hold the remaining toner collected by the collection member.

8 Claims, 5 Drawing Sheets

IMAGE FORMING APPARATUS

CROSS-REFERENCE TO RELATED APPLICATIONS

This application claims priority from Japanese Patent Application No. 2013-115777 filed on May 31, 2013, the entire subject-matter of which is incorporated herein by reference.

TECHNICAL FIELD

The disclosure relates to an image forming apparatus of an electrophotographic type.

BACKGROUND

An image forming apparatus of an electrophotographic type, there has been known an image forming apparatus including an image carrier, on which a developer image is carried, and a developing device configured to supply developer to the image carrier.

Regarding the above-described related-art image forming apparatus, there has been proposed a printer, which has a brush roller configured to collect transfer remaining toner remaining on a surface of a photosensitive member after a toner image is transferred, and which discharges the transfer remaining toner, which has been collected to the brush roller, to the photosensitive member at predetermined timing.

Further, as the above-described related-art image forming apparatus, there has been proposed an electrophotographic recording apparatus having a toner save mode in which a print operation is performed while reducing an amount of the toner to be used.

SUMMARY

Illustrative aspects of the invention provide an image forming apparatus capable of prolonging the exchange lifespan of an image carrier and a collection member when executing a mode of prolonging the exchange lifespan of a cartridge.

According to one illustrative aspect of the invention, there is provided an image forming apparatus comprising: an image carrier configured to carry a toner image thereon; a cartridge configured to accommodate therein toner and to supply the toner to the image carrier; a collection member configured to collect remaining toner which is attached to the image carrier after the toner image has been transferred from the image carrier to a recording medium; and a control device configured to selectively execute a first mode and a second mode, wherein the first mode is a mode in which an exchange lifespan of the cartridge is a first period, and wherein the second mode is a mode in which the exchange lifespan of the cartridge is a second period that is longer than the first period, wherein in a case of executing the first mode, the control device is configured to control the collection member to return the remaining toner collected by the collection member to the image carrier with a first frequency, and wherein in a case of executing the second mode, the control device is configured to control the collection member to return the remaining toner collected by the collection member to the image carrier with a second frequency that is smaller than the first frequency or to continuously hold the remaining toner collected by the collection member.

DETAILED DESCRIPTION

<General Overview>

Figure 1:
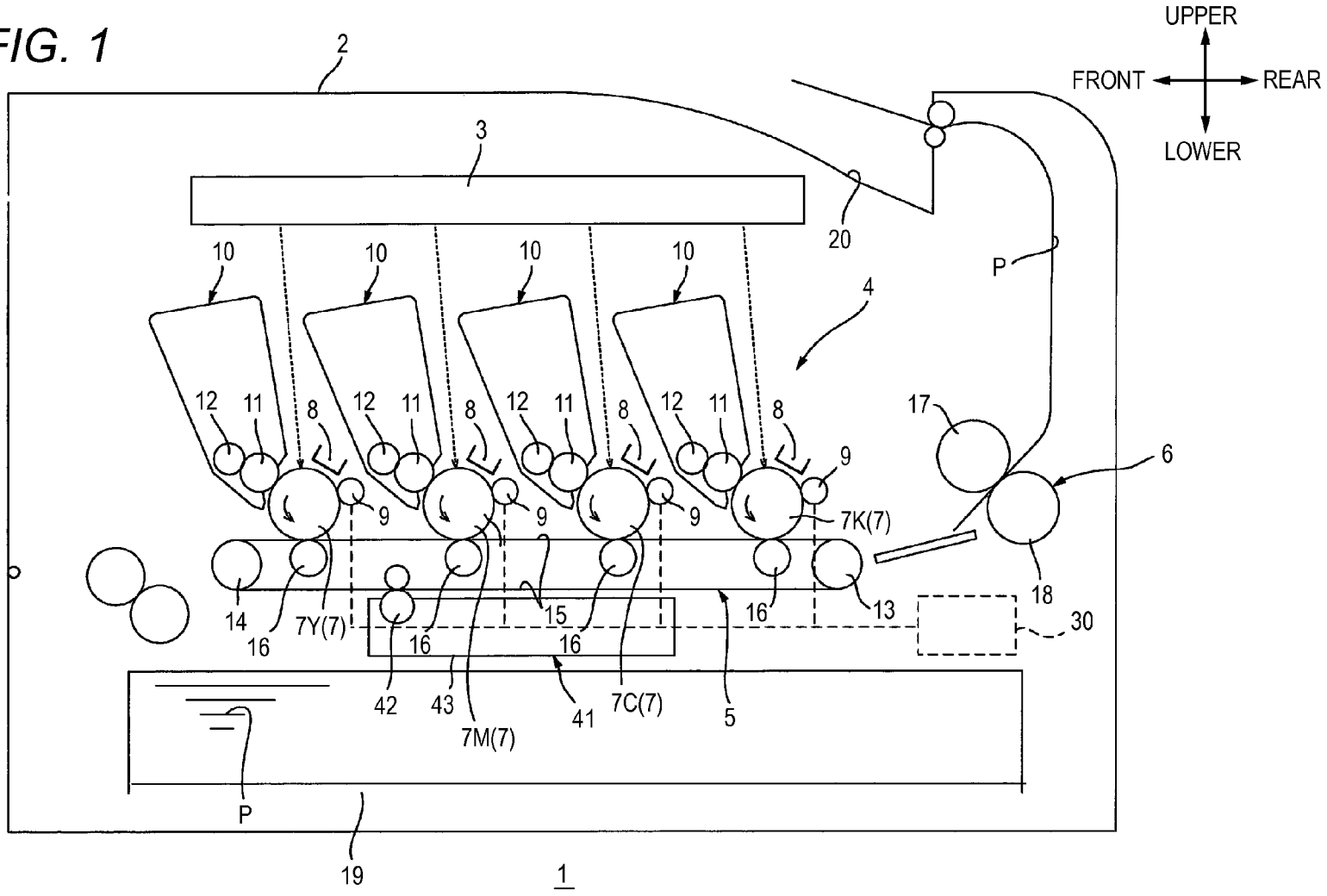
FIG. 1 is a central sectional view of a printer showing a first illustrative embodiment of an image forming apparatus of the invention.

In the toner save mode disclosed in the above-described related-art electrophotographic recording apparatus, since the amount of the toner to be used is reduced, it is thought that a generation amount of the transfer remaining toner is small.

In this case, when executing the discharge operation as described in the above-described related-art printer, the discharge operation is performed even though a collection amount of the transfer remaining toner is small. In other words, the image forming apparatus executes the discharge operation even though the brush roller can collect the transfer remaining toner. As the discharge operation is executed, the members such as the image carrier, the brush roller and the like are operated.

For this reason, it is difficult to suppress a wear damage of the members relating to the discharge operation. Thus, it is difficult to prolong the exchange lifespan of the members relating to the discharge operation.

Accordingly, illustrative aspects of the invention provide an image forming apparatus capable of prolonging the exchange lifespan of an image carrier and a collection member when executing a (second) mode of prolonging the exchange lifespan of a cartridge.

(1) According to one illustrative aspect of the invention, there may be provided an image forming apparatus comprising: an image carrier configured to carry a toner image thereon; a cartridge configured to accommodate therein toner and to supply the toner to the image carrier; a collection member configured to collect remaining toner which is attached to the image carrier after the toner image has been transferred from the image carrier to a recording medium; and a control device configured to selectively execute a first mode and a second mode, wherein the first mode is a mode in which an exchange lifespan of the cartridge is a first period, and wherein the second mode is a mode in which the exchange lifespan of the cartridge is a second period that is longer than the first period.

In a case of executing the first mode, the control device is configured to control the collection member to return the remaining toner collected by the collection member to the image carrier with a first frequency.

Further, in a case of executing the second mode, the control device is configured to control the collection member to return the remaining toner collected by the collection member to the image carrier with a second frequency that is smaller than the first frequency or to continuously hold the remaining toner collected by the collection member.

According to the above configuration, when executing the second mode of prolonging the exchange lifespan of the cartridge, the frequency of returning the remaining toner from the collection member to the image carrier is decreased or the remaining toner is not returned from the collection member to the image carrier.

For this reason, when executing the second mode, it is possible to reduce operations of the image carrier and the collection member.

As a result, when executing the second mode, it is possible to prolong the exchange lifespan of the image carrier and the collection member.

(2) According to another illustrative aspect, in the case of executing the second mode, the control device may be configured to control the collection member to collect the remaining toner attached to the image carrier.

According to the above configuration, it is possible to clean the image carrier in the second mode.

(3) According to still another illustrative aspect, in the case of executing the second mode, the control device may be configured to control the collection member to weaken collection of the remaining toner attached to the image carrier.

According to the above configuration, it is possible to suppress the remaining toner held on the collection member from being increased in the second mode.

(4) According to still another illustrative aspect, the image forming apparatus may further comprise a developer carrier configured to carry the toner to be supplied to the image carrier. The developer carrier may be configured to collect the remaining toner that the collection member has returned to the image carrier.

According to the above configuration, it is possible to collect the remaining toner by using the developer carrier. Thus, as compared to a configuration where a member for collecting the remaining toner is separately provided, it is possible to simplify the configuration of the image forming apparatus.

(5) According to still another illustrative aspect, in the case of executing the second mode, the control device may be configured to control the collection member to continuously held the remaining toner collected by the collection member.

(6) According to still another illustrative aspect, in the case of executing the first mode, the cartridge may be configured to supply a first amount of toner to the image carrier, and in the case of executing the second mode, the cartridge may be configured to supply a second amount of toner, which is less than the first amount, to the image carrier.

(7) According to still another illustrative aspect, the collection member may be a cleaning roller contacting with the image carrier.

(8) According to still another illustrative aspect, the collection member may be a charging roller configured to charge the image carrier.

According to the image forming apparatus of the invention, when executing the second mode of prolonging the exchange lifespan of the cartridge, it is possible to prolong the exchange lifespan of the image carrier and the collection member.

<Exemplary Embodiments>

1. Overall Configuration of Printer

As shown in FIG. 1, a printer 1 that is an example of the image forming apparatus is a direct tandem-type color laser printer of a horizontal arrangement type.

Incidentally, in the below descriptions, the directions are described on the basis of a state where the printer 1 is horizontally put. That is, the upper of FIG. 1 refers to the upper and the lower of FIG. 1 refers to the lower. Further, the left of FIG. 1 refers to the front and the right of FIG. 1 refers to the rear. Further, the left and the right are described on the basis of a state where the printer 1 is seen from the front. That is, the near side of FIG. 1 is the right, and the far side of FIG. 1 is the left.

The printer 1 has a scanner unit 3, a process unit 4, a transfer unit 5 and a fixing unit 6 in a main body casing 2 having a substantial box shape.

The scanner unit 3 is arranged at an upper part in the main body casing 2. As shown with dotted lines in FIG. 1, the scanner unit 3 emits laser beams, based on image data, towards photosensitive drums 7 (which will be described later) of the process unit 4, thereby exposing the photosensitive drums 7.

The process unit 4 is arranged below the scanner unit 3. The process unit 4 has a plurality of photosensitive drums 7 as an example of the image carrier, a plurality of scorotron-type chargers 8, a plurality of drum cleaning rollers 9 as an example of the collection member, and a plurality of developing cartridges 10 as an example of the developing device.

The photosensitive drums 7 correspond to yellow, magenta, cyan and black, respectively. Each of the photosensitive drums 7 is supported to a lower end portion of the process unit 4 so that it is rotated in a counterclockwise direction, when seen from the right side. The photosensitive drums 7 are respectively arranged in parallel with each other at an interval in order of yellow, magenta, cyan and black from the front towards the rear. Each of the photosensitive drums 7 has a substantially cylindrical shape that is long in a left-right direction.

The scorotron-type chargers 8 correspond to the photosensitive drums 7, respectively, and are arranged at an interval from a rear-upper side of the corresponding photosensitive drums 7.

The drum cleaning rollers 9 correspond to the photosensitive drums 7, respectively, and are contacted to rear end portions of the corresponding photosensitive drums 7.

The developing cartridges 10 correspond to the photosensitive drums 7, respectively, and are arranged above the corresponding photosensitive drums 7. Incidentally, as will be described later, each of the developing cartridges 10 is configured so that it is contacted to or spaced from the corresponding photosensitive drum 7. Each of the developing cartridges 10 has a developing roller 11 as an example of the developer carrier and a supply roller 12. Further, the developing cartridge 10 accommodates toner corresponding to each color in a space above the developing roller 11 and the supply roller 12.

The developing roller 11 is rotatably supported to a lower end portion of the developing cartridge 10 so that it is exposed rearwards. Further, the developing roller 11 is contacted to a front-upper end portion of the photosensitive drum 7.

The supply roller 12 is arranged at a front-upper side of the developing roller 11. The supply roller 12 is contacted to a front-upper end portion of the developing roller 11.

The transfer unit 5 is arranged below the process unit 4. The transfer unit 5 has a driving roller 13, a driven roller 14, a conveyance belt 15 and a plurality of transfer rollers 16.

The driving roller 13 is arranged at a rear end portion of the transfer unit 5.

The driven roller 14 is arranged at a front end portion of the transfer unit 5 so that it is arranged at an interval in front of the driving roller 13 and is opposed to the driving roller 13.

The conveyance belt 15 is wound around the driving roller 13 and the driven roller 14 so that an upper side thereof is contacted to all the photosensitive drums 7. The conveyance belt 15 circulates so that the upper side thereof is moved from the front towards the rear by driving rotation of the driving roller 13 and following movement of the driven roller 14.

The transfer rollers 16 correspond to the photosensitive drums 7, respectively, and are arranged below the corresponding photosensitive drums 7 with the upper side of the conveyance belt 15 being interposed therebetween.

The fixing unit 6 is arranged at the rear of the transfer unit 5 and has a heating roller 17 and a pressing roller 18 that contacts the heating roller 17.

When the printer 1 starts an image forming operation, the scorotron-type charger 8 uniformly charges a surface of the photosensitive drum 7. After that, the scanner unit 3 exposes the surface of the photosensitive drum 7. Thereby, an electrostatic latent image based on image data is formed on the surface of the photosensitive drum 7.

Further, the supply roller 12 supplies the toner in the developing cartridge 10 to the developing roller 11. At this time, the toner is positively friction-charged between the developing roller 11 and the supply roller 12 and is thus carried on the developing roller 11.

Then, the developing roller 11 supplies the carried toner to the electrostatic latent image on the surface of the photosensitive drum 7. Thereby, a toner image is carried on the surface of the photosensitive drum 7.

A sheet P that is an example of a recording medium is fed one at a time from a sheet feeding tray 19 to between the yellow photosensitive drum 7 and the corresponding transfer roller 12 at predetermined timing by rotations of the various rollers. Thereafter, the sheet P is conveyed from the front towards the rear by the conveyance belt 15. The toner image on the photosensitive drum 7 is transferred onto the sheet P when the sheet P passes between the photosensitive drum 7 and the transfer roller 16.

Then, the sheet P is heated and pressed when it passes between the heating roller 17 and the pressing roller 18. At this time, the toner image on the sheet P is heat-fixed on the sheet P. Then, the sheet P is discharged onto a sheet discharge tray 20.

2. Details of Printer (1) Belt Cleaner

The main body casing 2 has a belt cleaner 41.

The belt cleaner 41 is arranged below the transfer unit 5. The belt cleaner 41 has a transfer remaining toner accommodation member 43 and a belt cleaning roller 42.

The transfer remaining toner accommodation member 43 has a substantial box shape.

The belt cleaning roller 42 is rotatably supported to a rear-upper end portion of the transfer remaining toner accommodation member 43. The belt cleaning roller 42 has a substantially cylindrical shape extending in the left-right direction. An upper end portion of the belt cleaning roller 42 is exposed upwardly from the transfer remaining toner accommodation member 43 and is contacted to a lower side of the conveyance belt 15.

(2) Control Unit

The main body casing 2 has a control unit 30 as an example of the control device.

The control unit 30 has a CPU, a memory and the like. As shown with dotted line in FIG. 1, the control unit 30 is electrically connected to each of the drum cleaning rollers 9 through wirings. The control unit 30 applies a predetermined drum cleaning bias to each of the drum cleaning rollers 9.

3. Image Forming Operation

The printer 1 can switch a normal printing mode and a toner save mode under control of the control unit 30. The toner save mode is a mode of lowering a printing density, a resolution and the like, as compared to the normal printing mode. In the toner save mode, since a consumption amount of the toner is reduced, it is possible to prolong the exchange lifespan of the developing cartridge 10. Specifically, if the developing cartridge 10 can print 3,000 sheets when performing the printing in the normal printing mode, for example, 4,000 sheets can be printed in the toner save mode, for example. That is, the exchange lifespan of the developing cartridge 10 in the toner save mode is prolonged from a first period for which 3,000 sheets can be printed to a second period for which 4,000 sheets can be printed. The normal printing mode is an example of the first mode and the toner save mode is an example of the second mode.

(1) Normal Printing Mode

When a printing job of designating the normal printing mode is input to the printer 1, the control unit 30 operates the printer 1 in the normal printing mode.

Figure 2A:
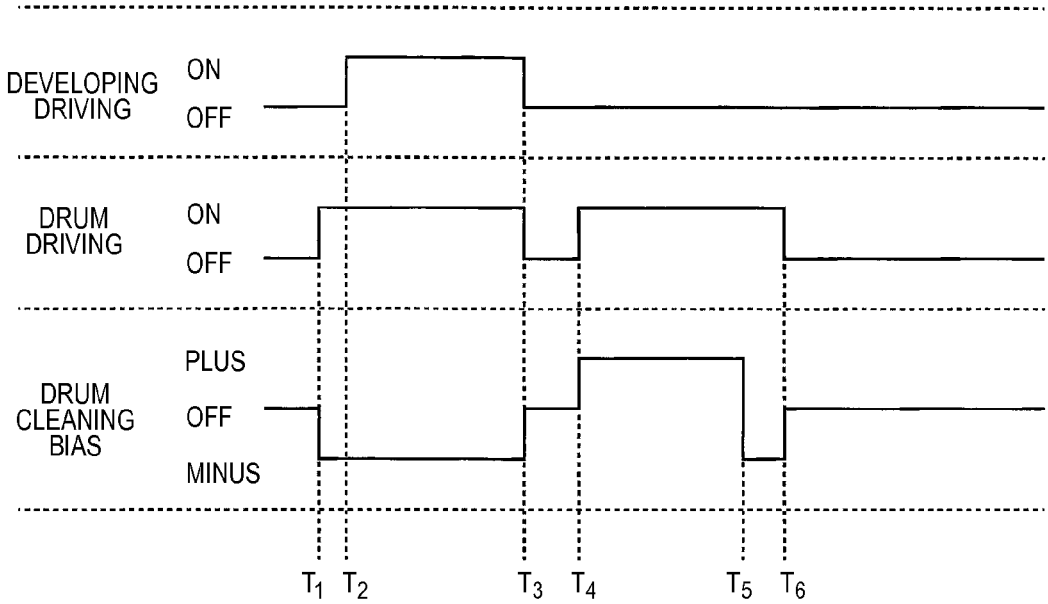
FIGS. 2A and 2B are timing charts showing an operation of the printer shown in FIG. 1.

In this case, the control unit 30 first drives the respective photosensitive drums 7, as shown with $T_1$ in FIG. 2A. Further, the control unit 30 applies a drum cleaning bias having a negative polarity opposite to a charged polarity of the toner to each of the drum cleaning rollers 9.

Incidentally, at this time, although not shown, the control unit 30 applies a predetermined charging bias to each scorotron-type charger 8 and applies a predetermined transfer bias to each transfer roller 16.

Then, as shown with $T_2$ in FIG. 2A, the control unit 30 drives the respective developing cartridges 10. At this time, each developing cartridge 10 supplies a predetermined amount of toner to the corresponding photosensitive drum 7. The supply amount of the toner to the photosensitive drum 7 can be set to a predetermined amount by adjusting a rotating speed of the developing roller 11, a developing bias to be applied to the developing roller 11, a light quantity of the scanner unit 3 and the like.

Thereafter, as described above, the image forming operation starts. At this time, the transfer remaining toners attached to the respective photosensitive drums 7 after the toner images are transferred are collected by the corresponding drum cleaning rollers 9 and are electrostatically held on the corresponding drum cleaning rollers 9.

Then, when the image forming operation is over, the control unit 30 stops driving the respective photosensitive drums 7 and also stops applying the drum cleaning biases to the respective drum cleaning rollers 9, as shown with $T_3$ in FIG. 2A.

Incidentally, at this time, although not shown, the control unit 30 also stops applying the charging biases to the respective scorotron-type chargers 8 and applying the transfer biases to the respective transfer rollers 16.

In the normal printing mode, after the image forming operation is over, the transfer remaining toners held on the drum cleaning rollers 9 are collected to the belt cleaner 41 at predetermined timing.

First, in order to collect the transfer remaining toner, the control unit 30 drives the respective photosensitive drums 7, as shown with $T_4$ in FIG. 2A. Further, the control unit 30 applies a drum cleaning bias having the same positive polarity as the charged polarity of the toner to each drum cleaning roller 9.

Incidentally, at this time, although not shown, the control unit 30 applies a predetermined charging bias to each scorotron-type charger 8 and also applies a predetermined transfer bias to each transfer roller 16.

Resultantly, the transfer remaining toners held on the respective drum cleaning rollers 9 are discharged to the surfaces of the corresponding photosensitive drums 7 by the positive drum cleaning biases.

After that, the transfer remaining toners discharged to the surfaces of the photosensitive drums 7 are transferred to the surface of the conveyance belt 15 by the transfer biases and are collected to the belt cleaner 41 as the conveyance belt 15 circulates.

Thereafter, the control unit 30 switches the drum cleaning bias, which is applied to each drum cleaning roller 9, to a drum cleaning bias having a negative polarity opposite to the charged polarity of the toner, as shown with $T_5$ in FIG. 2A.

Thereby, the surfaces of the photosensitive drums 7, which have been used for collection of the transfer remaining toners, are again cleaned.

Then, the control unit 30 stops driving the respective photosensitive drums 7 and also stops applying the drum cleaning biases to the respective drum cleaning rollers 9, as shown with $T_6$ in FIG. 2A.

Incidentally, at this time, although not shown, the control unit 30 also stops applying the charging biases to the respective scorotron-type chargers 8 and applying the transfer biases to the respective transfer rollers 16.

In this way, the normal printing mode is executed.

(2) Toner Saving Mode

When a printing job of designating the toner save mode is input to the printer 1, the control unit 30 operates the printer 1 in the toner save mode.

Figure 2B:
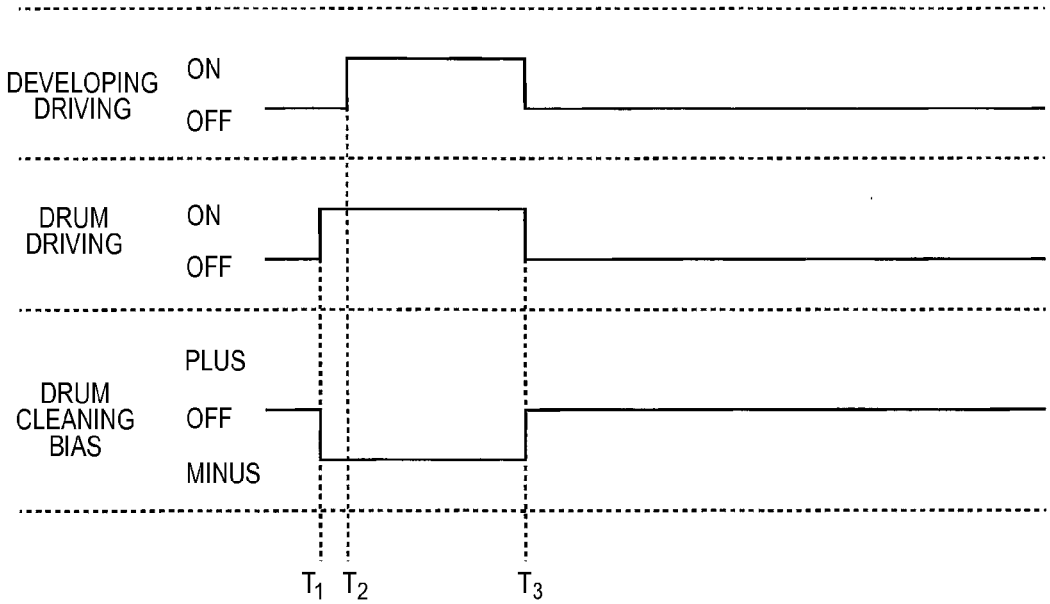

In this case, the control unit 30 first drives the respective photosensitive drums 7, as shown with $T_1$ in FIG. 2B. Further, the control unit 30 applies a drum cleaning bias having a negative polarity opposite to the charged polarity of the toner to each of the drum cleaning rollers 9.

Incidentally, at this time, although not shown, the control unit 30 applies a predetermined charging bias to each scorotron-type charger 8 and applies a predetermined transfer bias to each transfer roller 16.

Then, as shown with $T_2$ in FIG. 2B, the control unit 30 drives the respective developing cartridges 10. At this time, each developing cartridge 10 supplies a smaller amount of toner than the normal printing mode to the corresponding photosensitive drum 7. In order to reduce the supply amount of the toner to the photosensitive drum 7, a method of reducing a rotating speed of the developing roller 11, a method of lowering the developing bias to be applied to the developing roller 11, a method of reducing a light quantity of the scanner unit 3, a method of decreasing an area ratio when converting print data into binary exposing data, and the like may be used, for example.

Thereafter, as described above, the image forming operation starts. At this time, the transfer remaining toners attached to the respective photosensitive drums 7 after the toner images are transferred are collected by the corresponding drum cleaning rollers 9 and are electrostatically held on the corresponding drum cleaning rollers 9.

Then, when the image forming operation is over, the control unit 30 stops driving the respective photosensitive drums 7 and also stops applying the drum cleaning biases to the respective drum cleaning rollers 9, as shown with $T_3$ in FIG. 2B.

Incidentally, at this time, although not shown, the control unit 30 also stops applying the charging biases to the respective scorotron-type chargers 8 and applying the transfer biases to the respective transfer rollers 16.

In the toner save mode, as shown in FIG. 2B, after the image forming operation is over, the operation of collecting the transfer remaining toners held on the drum cleaning rollers 9 is not performed. In this case, the drum cleaning rollers 9 keep holding the transfer remaining toners thereon. Incidentally, the transfer remaining toners generated in the toner save mode are collected to the belt cleaner 41 when the above-described normal printing mode is thereafter executed.

In this way, the toner save mode is executed.

4. Advantages (1) According to the printer 1, as shown in FIG. 2B, when executing the toner save mode of prolonging the exchange lifespan of the developing cartridge 10, the transfer remaining toners are not returned from the drum cleaning rollers 9 to the photosensitive drums 7.

For this reason, when executing the toner save mode, it is possible to reduce the operation of the photosensitive drums 7 and the drum cleaning rollers 9.

As a result, when executing the toner save mode, it is possible to prolong the exchange lifespan of the photosensitive drums 7 and the drum cleaning rollers 9.

(2) Further, according to the printer 1, as shown in FIG. 2B, when executing the toner save mode, the control unit 30 controls the drum cleaning rollers 9 to collect the transfer remaining toners attached to the photosensitive drums 7.

As a result, in the toner save mode, it is possible to clean the photosensitive drums 7.

5. Second Illustrative Embodiment

A second illustrative embodiment of the printer is described with reference to FIG. 3. Incidentally, in the second illustrative embodiment, the same members as those of the first illustrative embodiment are denoted with the same reference numerals and the descriptions thereof are omitted.

(1) Printing Operation in Second Illustrative Embodiment

In the first illustrative embodiment, when executing the toner save mode, the control unit 30 applies the drum cleaning bias having the negative polarity opposite to the charged polarity of the toner to each drum cleaning roller 9. Thereby, each drum cleaning roller 9 cleans the corresponding photosensitive drum 7 even in the toner save mode.

Figure 3:
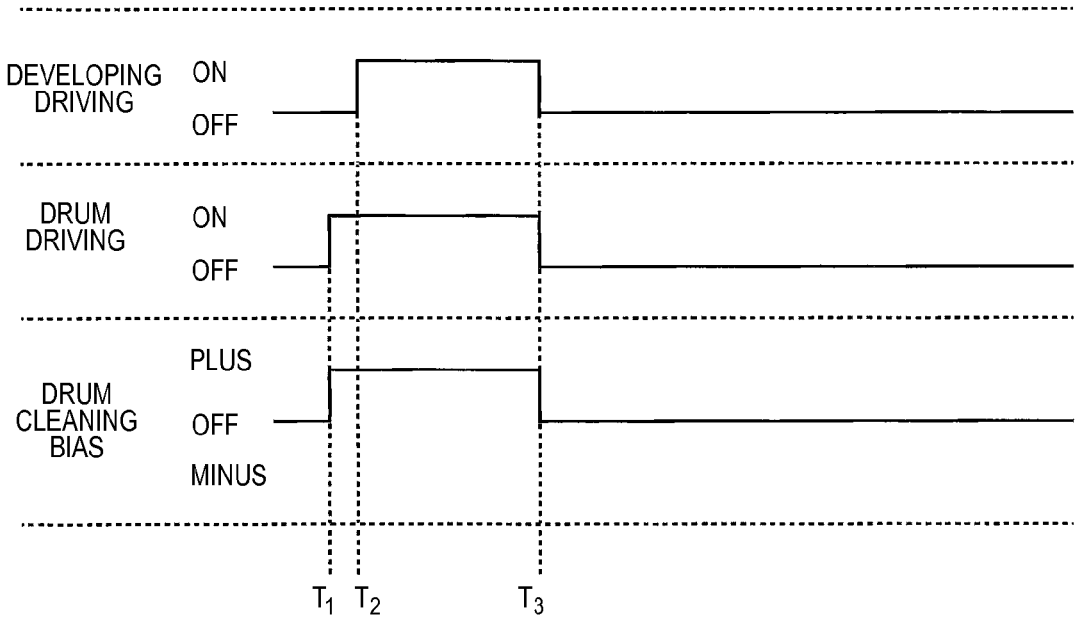
FIG. 3 is a timing chart showing an operation of a printer according to a second illustrative embodiment.

In contrast, in the second illustrative embodiment, as shown with $T_1$ in FIG. 3, when executing the toner save mode, the control unit 30 applies a drum cleaning bias having the same positive polarity as the charged polarity of the toner each drum cleaning roller 9. That is, in the toner save mode, each drum cleaning roller 9 collects only the negatively charged toner, i.e., reversely charged toner on the corresponding photosensitive drum 7 and does not collect the positively charged toner. In other words, in the toner save mode, each drum cleaning roller 9 has a weaker collecting force as regards the corresponding photosensitive drum 7.

(2) Advantages of Second Illustrative Embodiment (2-1) According to the second illustrative embodiment, in the toner save mode, it is possible to suppress the transfer remaining toner held on the drum cleaning roller 9 from being increased.

For this reason, when continuously executing the toner save mode, it is possible to prevent the drum cleaning roller 9 from excessively holding the transfer remaining toner.

Incidentally, in the second illustrative embodiment, in the toner save mode, even when the force of the drum cleaning roller 9 of collecting the positively charged transfer remaining toner is weakened, the positively charged transfer remaining toner, which has not been collected to the drum cleaning roller 9, can be collected with the developing roller 11.

(2-2) Also in the second illustrative embodiment, it is possible to realize the same advantages as the first illustrative embodiment.

6. Third Illustrative Embodiment

A third illustrative embodiment of the printer is described with reference to FIGS. 4 and 5. Incidentally, in the third illustrative embodiment, the same members as those of the first illustrative embodiment are denoted with the same reference numerals and the descriptions thereof are omitted.

(1) Outline of Third Illustrative Embodiment

In the first illustrative embodiment, the printer 1 is configured as the color printer. However, in the third illustrative embodiment, a printer 51 is configured as a monochrome printer.

Figure 4:
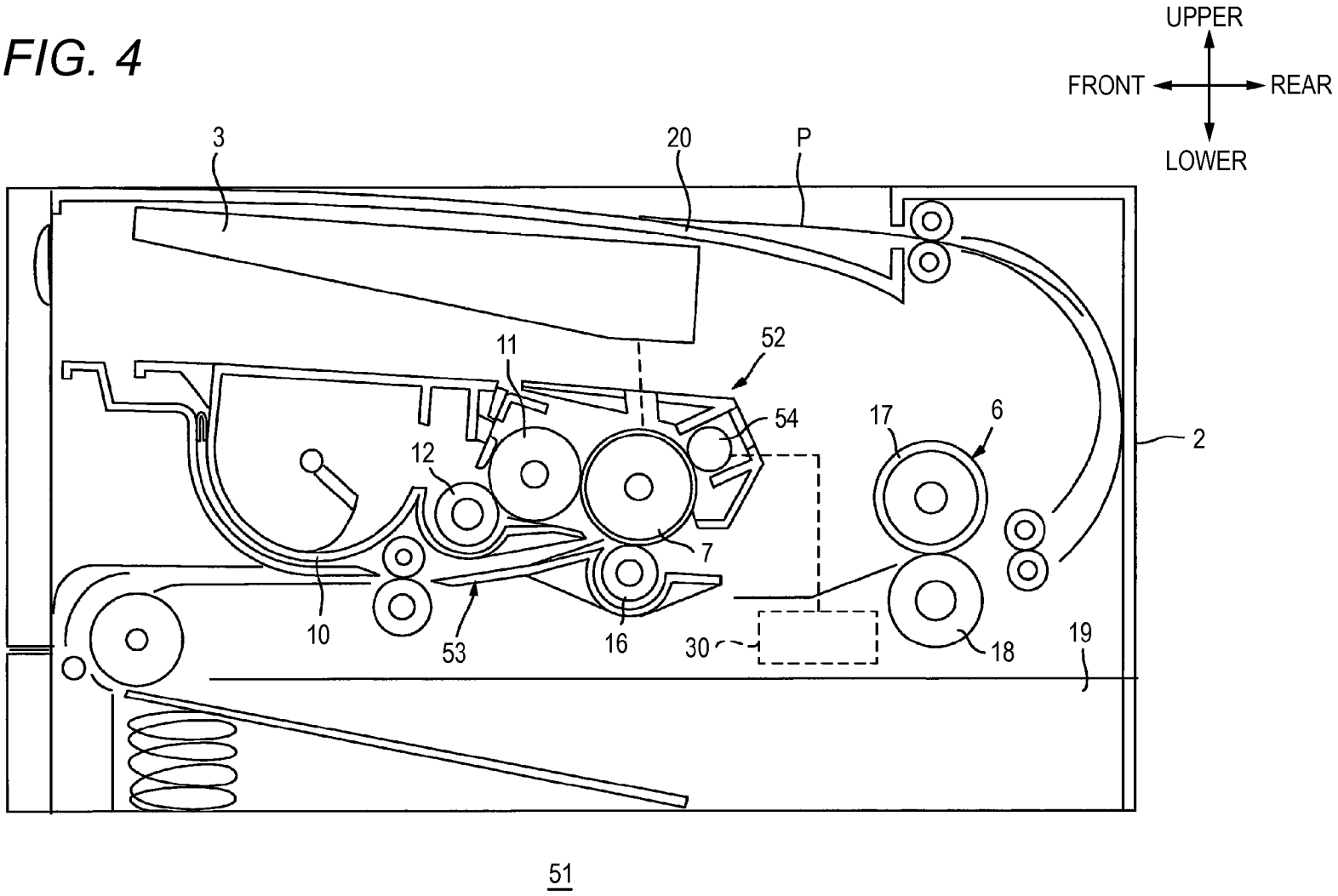
FIG. 4 is a central sectional view of a printer according to a third illustrative embodiment.

Specifically, as shown in FIG. 4, the printer 51 has one process cartridge 52, instead of the four process units 4, and does not have the transfer unit 5 and the belt cleaner 41, in contrast to the first illustrative embodiment.

The process cartridge 52 has a developing cartridge 10 and a drum cartridge 53 configured to mount the developing cartridge 10 thereto.

In contrast to the first illustrative embodiment, the developing cartridge 10 is all the time contacted to the photosensitive drum 7 at a state where the developing cartridge 10 is mounted to the drum cartridge 53.

The drum cartridge 53 has the photosensitive drum 7, a charging roller 54 as an example of the collection member and the transfer roller 16, one by one. The drum cartridge 53 does not have the drum cleaning roller 9.

(2) Details of Printer (2-1) Charging Roller

The charging roller 54 is arranged at a rear-upper side of the photosensitive drum 7. The charging roller 54 has a substantially cylindrical shape extending in the left-right direction. The charging roller 54 is contacted to a rear-upper end portion of the photosensitive drum 7.

(2-2) Control Unit

As shown with dotted lines in FIG. 4, the control unit 30 is electrically connected to the charging roller 54 through a wiring. The control unit 30 applies a predetermined charging bias to the charging roller 54.

(3) Image Forming Operation (3-1) Normal Printing Mode

When a printing job of designating the normal printing mode is input to the printer 51, the control unit 30 operates the printer 51 in the normal printing mode.

Figure 5A:
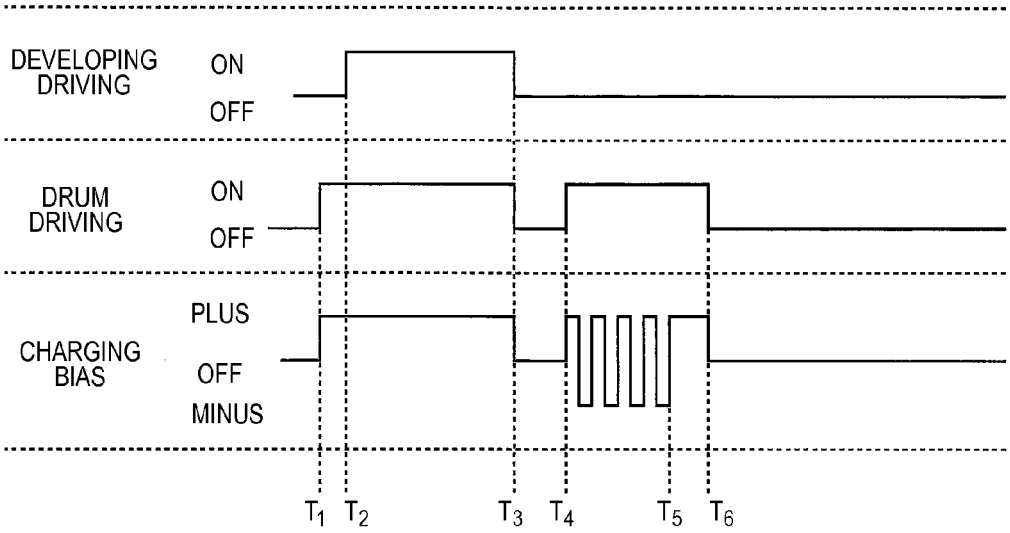
FIGS. 5A and 5B are timing charts showing an operation of the printer according to the third illustrative embodiment.

In this case, the control unit 30 first drives the photosensitive drum 7, as shown with $T_1$ in FIG. 5A. Further, the control unit 30 applies a charging bias having the same positive polarity as the charged polarity of the toner to the charging roller 54.

Incidentally, at this time, although not shown, the control unit 30 applies a predetermined transfer bias to the transfer roller 16.

Then, as shown with $T_2$ in FIG. 5A, the control unit 30 drives the developing cartridge 10. At this time, the developing cartridge 10 supplies a predetermined amount of toner to the corresponding photosensitive drum 7.

Thereafter, as described above, the image forming operation starts. At this time, the reversely charged toner of the transfer remaining toners attached to the photosensitive drum 7 after the toner image is transferred is electrostatically held on the charging roller 54.

Then, when the image forming operation is over, the control unit 30 stops driving the photosensitive drum 7 and also stops applying the drum cleaning bias to the drum cleaning roller 9, as shown with $T_3$ in FIG. 5A.

Incidentally, at this time, although not shown, the control unit 30 also stops applying the transfer bias to the transfer roller 16.

In the normal printing mode, after the image forming operation is over, the transfer remaining toner held on the drum cleaning roller 9 is collected to the developing cartridge 10 at predetermined timing.

In order to collect the transfer remaining toner, the control unit 30 drives the photosensitive drum 7, as shown with $T_4$ in FIG. 5A. Further, the control unit 30 switches the charging bias to be applied to the charging roller 54 between the positive charging bias and the negative charging bias in conformity to the period of the photosensitive drum 7.

Resultantly, the transfer remaining toner held on the charging roller 54 is discharged to the surface of the corresponding photosensitive drum 7 when the charging bias is positive.

After that, the transfer remaining toner discharged to the surface of the photosensitive drum 7 is collected to the developing cartridge 10 by the developing roller 11.

Thereafter, the control unit 30 switches the charging bias, which is applied to the charging roller 54, to a charging bias having the same positive polarity as the charged polarity of the toner, as shown with $T_5$ in FIG. 5A.

Then, the control unit 30 stops driving the photosensitive drum 7 and also stops applying the charging bias to the charging roller 54, as shown with $T_6$ in FIG. 5A.

In this way, the normal printing mode is executed.

(3-2) Toner Saving Mode

When a printing job of designating the toner save mode is input to the printer 51, the control unit 30 operates the printer 51 in the toner save mode.

Figure 5B:
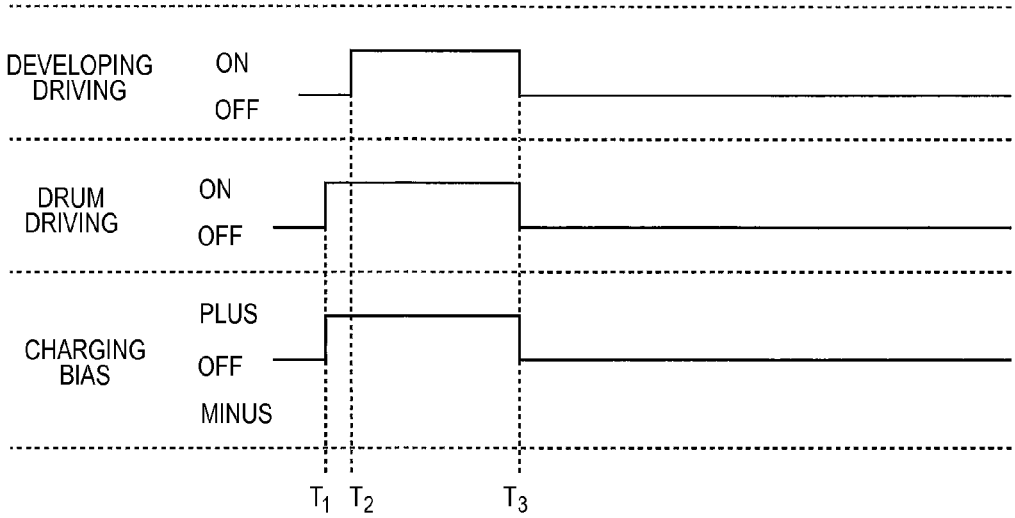

In this case, the control unit 30 first drives the photosensitive drum 7, as shown with $T_1$ in FIG. 5B. Further, the control unit 30 applies a charging bias having the same positive polarity as the charged polarity of the toner to the charging roller 54.

Incidentally, at this time, although not shown, the control unit 30 applies a predetermined transfer bias to the transfer roller 16.

Then, as shown with $T_2$ in FIG. 5B, the control unit 30 drives the developing cartridge 10. At this time, the developing cartridge 10 supplies a smaller amount of toner than the normal printing mode to the corresponding photosensitive drum 7.

Thereafter, as described above, the image forming operation starts. At this time, the reversely charged toner of the transfer remaining toners attached to the photosensitive drum 7 after the toner image is transferred is electrostatically held on the charging roller 54.

Then, when the image forming operation is over, the control unit 30 stops driving the photosensitive drum 7 and also stops applying the charging bias to the charging roller 54, as shown with $T_3$ in FIG. 5B.

Incidentally, at this time, although not shown, the control unit 30 also stops applying the transfer bias to the transfer roller 16.

In the toner save mode, as shown in FIG. 5B, after the image forming operation is over, the operation of collecting the transfer remaining toner held on the charging roller 54 is not performed. In this case, the charging roller 54 keeps holding the transfer remaining toner thereon. Incidentally, the transfer remaining toner generated in the toner save mode is collected to the developing cartridge 10 when the above-described normal printing mode is thereafter executed.

In this way, the toner save mode is executed.

(4) Advantages of Third Illustrative Embodiment (4-1) According to the printer 51 of the third illustrative embodiment, it is possible to collect the transfer remaining toner by using the developing roller 11. Further, as compared to a configuration where a member for collecting the transfer remaining toner is separately provided, it is possible to simplify the configuration of the printer 51.

(4-2) Also in the third illustrative embodiment, it is possible to realize the same advantages as the first illustrative embodiment.

7. Modified Embodiments

In the respective illustrative embodiments, in the toner save mode, the collection operation of the transfer remaining toner is not performed. However, in the toner save mode, the control may be performed to reduce an execution frequency of the collection operation of the transfer remaining toner.

Specifically, in the normal printing mode, the collection operation of the transfer remaining toner may be executed for each printing job, i.e., with a first frequency, and in the toner save mode, the collection operation of the transfer remaining toner may be executed for printing jobs, i.e., with a second frequency smaller than the first frequency.

What is claimed is:

1. An image forming apparatus comprising:

an image carrier configured to carry a toner image thereon;

a cartridge configured to accommodate toner therein and to supply the toner to the image carrier;

a collection member configured to collect remaining toner which is attached to the image carrier after the toner image has been transferred from the image carrier to a recording medium; and a control device configured to selectively execute a first mode and a second mode, wherein the first mode is a mode in which an exchange lifespan of the cartridge is a first period, and wherein the second mode is a mode in which the exchange lifespan of the cartridge is a second period that is longer than the first period, wherein in a case of executing the first mode, the control device is configured to control the collection member to return the remaining toner collected by the collection member to the image carrier with a first frequency, and wherein in a case of executing the second mode, the control device is configured to control the collection member to return the remaining toner collected by the collection member to the image carrier with a second frequency that is smaller than the first frequency or to continuously hold the remaining toner collected by the collection member.

2. The image forming apparatus according to claim 1, wherein in the case of executing the second mode, the control device is configured to control the collection member to collect the remaining toner attached to the image carrier.

3. The image forming apparatus according to claim 1, wherein in the case of executing the second mode, the control device is configured to control the collection member to weaken collection of the remaining toner attached to the image carrier.

4. The image forming apparatus according to claim 1, further comprising a developer carrier configured to carry the toner to be supplied to the image carrier, wherein the developer carrier is configured to collect the remaining toner that the collection member has returned to the image carrier.

5. The image forming apparatus according to claim 1, wherein in the case of executing the second mode, the control device is configured to control the collection member to continuously hold the remaining toner collected by the collection member.

6. The image forming apparatus according to claim 1, wherein in the case of executing the first mode, the cartridge is configured to supply a first amount of toner to the image carrier, and wherein in the case of executing the second mode, the cartridge is configured to supply a second amount of toner, which is less than the first amount, to the image carrier.

7. The image forming apparatus according to claim 1, wherein the collection member is a cleaning roller contacting the image carrier.

8. The image forming apparatus according to claim 1, wherein the collection member is a charging roller configured to charge the image carrier.

* * * * *